US009022884B2

(12) United States Patent
Dunno, Jr.

(10) Patent No.: US 9,022,884 B2
(45) Date of Patent: May 5, 2015

(54) LEG DRIVE MEASURING AND TRAINING APPARATUS FOR BASEBALL AND SOFTBALL PITCHERS

(71) Applicant: Richard E. Dunno, Jr., Fort Wayne, IN (US)

(72) Inventor: Richard E. Dunno, Jr., Fort Wayne, IN (US)

( * ) Notice: Subject to any disclaimer, the term of this patent is extended or adjusted under 35 U.S.C. 154(b) by 119 days.

(21) Appl. No.: 13/950,313

(22) Filed: Jul. 25, 2013

(65) Prior Publication Data

US 2015/0031479 A1 Jan. 29, 2015

(51) Int. Cl.
*A63B 69/00* (2006.01)

(52) U.S. Cl.
CPC ..... *A63B 69/0002* (2013.01); *A63B 2243/0008* (2013.01); *A63B 2069/0006* (2013.01); *A63B 2220/51* (2013.01)

(58) Field of Classification Search
USPC ..... 473/451–455; 482/123, 128
See application file for complete search history.

(56) References Cited

U.S. PATENT DOCUMENTS

| | | | | | |
|---|---|---|---|---|---|
| 2,720,396 | A | * | 10/1955 | Pfaus | 482/130 |
| 3,620,530 | A | * | 11/1971 | Cosby | 482/130 |
| 4,461,472 | A | * | 7/1984 | Martinez | 482/79 |
| 4,522,392 | A | * | 6/1985 | Torii | 482/128 |
| 4,591,154 | A | * | 5/1986 | Santarone | 473/497 |
| 4,619,454 | A | * | 10/1986 | Walton | 482/128 |
| 4,666,155 | A | * | 5/1987 | Stille | 473/497 |
| 5,160,304 | A | * | 11/1992 | Van Der Hoeven | 482/128 |
| 5,213,323 | A | | 5/1993 | Novinsky | |
| 5,480,367 | A | * | 1/1996 | Bergman | 482/122 |
| 5,945,610 | A | | 8/1999 | Galasso | |
| 6,093,119 | A | * | 7/2000 | Tipton | 473/438 |
| 6,386,996 | B1 | | 5/2002 | Foster | |
| 6,500,078 | B1 | | 12/2002 | Williams et al. | |
| 6,616,556 | B1 | | 9/2003 | Osmudsen | |
| 6,843,739 | B2 | * | 1/2005 | Putnam | 473/497 |
| 6,939,278 | B2 | * | 9/2005 | Atwell | 482/142 |
| 6,945,883 | B1 | * | 9/2005 | Williams et al. | 473/452 |
| 7,488,265 | B2 | | 2/2009 | Miller et al. | |
| 7,621,831 | B2 | | 11/2009 | Roberts | |
| 7,677,988 | B2 | * | 3/2010 | McMillan | 473/278 |
| 8,167,746 | B2 | | 5/2012 | Massaro | |
| 8,740,731 | B2 | * | 6/2014 | Miller et al. | 473/452 |
| 2006/0100042 | A1 | * | 5/2006 | Bykowsky | 473/497 |
| 2006/0160663 | A1 | | 7/2006 | Serritella | |
| 2007/0202970 | A1 | * | 8/2007 | Miller et al. | 473/451 |
| 2010/0234769 | A1 | | 9/2010 | Poliac et al. | |
| 2011/0021296 | A1 | * | 1/2011 | Johnston | 473/452 |
| 2012/0021854 | A1 | | 1/2012 | Miller et al. | |
| 2012/0214621 | A1 | | 8/2012 | Miller et al. | |
| 2014/0141948 | A1 | * | 5/2014 | Aronson et al. | 482/128 |
| 2014/0302950 | A1 | * | 10/2014 | Burt | 473/451 |

* cited by examiner

*Primary Examiner* — Mark Graham
(74) *Attorney, Agent, or Firm* — George Pappas

(57) ABSTRACT

An apparatus for measuring a baseball and softball pitcher's "leg drive" for training and coaching purposes and for developing a strong leg drive. The apparatus includes a lower ground engaging plate and an upper pitcher's foot supporting plate. The plates are slidingly secured to one another such that the upper plate is linearly moveable relative to the lower plate. A force measuring element is provided between the upper and lower plates. A pitchers rubber is secured to the upper plate. A pitcher uses the apparatus by stepping on the upper plate and pushing against the rubber while pitching, thereby linearly moving the upper plate against the element. The element thereby provides an output indicative of the pitcher's leg drive. The element can be a load cell or a spring mechanism. An audible sound is generated when the spring force is overcome.

27 Claims, 11 Drawing Sheets

LEG DRIVE MEASURING AND TRAINING APPARATUS FOR BASEBALL AND SOFTBALL PITCHERS

BACKGROUND OF THE INVENTION

1. Field of the Invention

The present invention relates to the field of apparatus and methods used for measuring a baseball and softball pitcher's "leg drive" for training and coaching purposes and for developing a strong leg drive.

2. Background

As is well known to those familiar with the games of baseball and softball, the pitcher throws the ball directing it over home plate whereat the batter attempts to hit it with a bat. It is, of course, desirable to throw the ball at a high velocity for thereby minimizing the batter's chances of hitting it. In this regard, the pitcher's mound includes a pitching rubber and, after wind up and during delivery of the ball, pitchers push against the rubber and thereby "drive" the ball at a desired velocity. The force exerted by pitchers against the rubber is known as the pitcher's "leg drive". It has been found that the velocity at which the ball is thrown can be increased by increasing the pitcher's leg drive force.

Devices for measuring "leg drive" are currently known. For example, Osmundson U.S. Pat. No. 6,616,556 discloses a method and apparatus for measuring leg drive wherein a pressure transducer element or gauge is integrated into a pitching rubber and wherein the output of the pressure gauge is used for creating a "leg drive" pressure profile. The device is useful in evaluating baseball pitchers, determining if a pitcher has recovered from injury, determining if a pitcher is tiring during a game, providing an indication of the pitchers ability to throw hard, for training and coaching purposes for developing a strong leg drive, etc. However, this apparatus cannot be used without a display device such as a computer making it generally cumbersome for use outdoors on baseball fields. Because this apparatus locates the pressure transducer element(s) along the front surface of the pitching rubber, the output is dependent on the pitcher making proper contact therewith. Accordingly, this apparatus could potentially be unreliable.

A need exists for an improved leg drive measuring and training apparatus which is generally easily usable and which reliably provides a consistent output indicative of the leg drive.

SUMMARY OF THE INVENTION

The object of the present invention is to provide a leg drive measuring and training apparatus which overcomes the deficiencies of prior apparatus, which is generally easily usable for measuring leg drive and for training purposes, and which reliably provides a consistent output of the leg drive.

In one form thereof the present invention is directed to a pitching training apparatus. The apparatus includes a lower ground engaging plate and an upper pitcher's foot supporting plate. The lower and upper plates are linearly movable relative to each other. A force measuring element is provided between the upper and lower plates whereby, by pushing against the upper plate while pitching, the upper plate moves linearly and the force element exhibits an output indicative of the pitcher's leg drive.

In another form thereof, the present invention is directed to a pitching training apparatus including a lower ground engaging plate and an upper pitcher's foot supporting plate. The lower and upper plates are movable relative to each other in a linear direction. A spring element is provided between the upper and lower plates whereby, by pushing against the upper plate while pitching, the upper plate moves linearly and the spring element exhibits an output indicative of the pitcher's leg drive.

Preferably, a pitchers rubber is secured to the upper plate. Also preferably, a plurality of slides are sandwiched between the upper and lower plates, wherein each of the slides is secured to each of the lower and upper plates whereby the lower and upper plates are linearly movable relative to each other. Further preferably, a pair of oval holes are provided extending through the upper plate and a shoulder bolt is received through each of the holes and is secured to the lower plate, whereby the upper and lower plates are maintained parallel adjacent one another and the linear movement is limited by the size of the holes.

The element can be a load cell providing an electrical output indicative of the pitcher's leg drive and the output can further include an audible sound.

The element can also comprise a spring mechanism. The mechanism includes a cylindrical shell having a bore extending therethrough. A plunger is located in the bore and having a terminal end projecting beyond the shell. The plunger terminal end abuts the upper plate. A spring is located in the bore urging the plunger against the upper plate with a spring force. A threaded fastener is provided adjacent the spring. The fastener is adapted to engage the spring and thereby adjust a length of the spring, whereby the spring force is selectively adjustable. The output can include an audible sound generated by the upper plate hitting the shell when the spring force is overcome.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
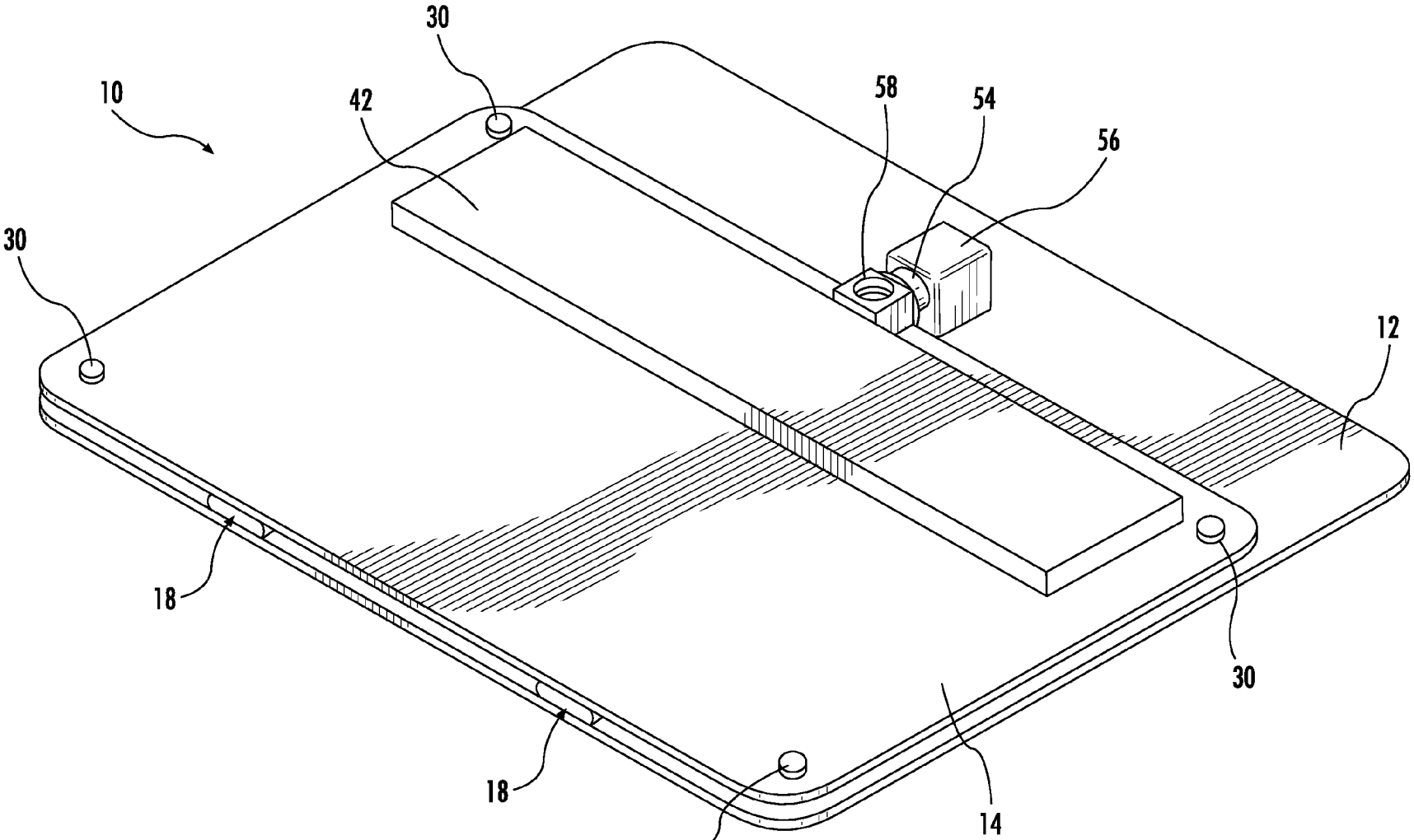
FIG. 1 is a perspective view of a first embodiment of a leg drive measuring and training apparatus constructed in accordance with the principles of the present invention.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

A leg drive measuring and training apparatus constructed in accordance with the principles of the present invention is shown in the drawings and generally designated by the numeral 10. Apparatus 10 can be used by baseball and softball pitchers and coaches for measuring leg drive, for training purposes and for increasing leg drive. Although described herein for use by baseball and softball pitchers and coaches, it should be understood that the apparatus 10 can be used for measuring leg drive in other sports and other applications.

Apparatus 10 includes a lower ground engaging plate 12 and an upper pitcher's foot supporting plate 14. Plates 12, 14 are preferably made of 3/16 inch thick steel which have been surface treated to prevent rust such as by painting, galvanizing, etc. Plates 12, 14 can also be made of other materials including, for example, aluminum, plastics and nylon. The lower ground engaging plate is rectangular having a front edge 12F, a left edge 12L, a right edge 12R and a back edge 12B. Ground engaging plate 12 is preferably about 15×17 inches. The upper plate 14 is also rectangular having a front edge 14F, a left edge 14L, aright edge 14R and a back edge 14B. Upper plate 14 is preferably about 13×15 inches.

Plates 12 and 14 are slidingly secured to one another whereby, when the lower plate 12 is engaged or otherwise secured to the ground, upper plate 14 is slidingly linearly movable along a plane parallel with the plates 12, 14 and in a direction as indicated by arrows 16. In this regard, a pair of slides 18 are provided and are sandwiched and secured between the upper and lower plates 12, 14. Slides 18 can be center mount ball-bearing drawer slides having a lower slide bar 20 slidingly secured to an upper slide bar 22 in a known and customary manner. Drawer slides 18 are well known, commercially available, and are commonly used for slidingly supporting cabinet drawers and other objects. It is contemplated that other slide devices, mechanisms and structures can equally be used which are capable of slidingly securing upper and lower plates 12, 14 to one another and allowing them to slide linearly relative to each other in a plane as indicated by arrows 16.

As best seen in FIGS. 7-11, the lower slide bars 20 of each of the slides 18 are secured to the lower plate 12 with spring/roll pin fasteners 24 which extend through holes (not shown) in the lower slide bars 20 and holes 26 in the lower plate 12. Similarly, the upper slide bars 22 of each of the slides 18 are secured to the upper plate 14 with spring/roll pin fasteners 24 which extend through holes 27 in the upper slide bars 22 and holes 28 in the upper plate 14. For added strength, the spring/roll pin fasteners can be tack welded in their respective holes.

The lower and upper plates 12, 14 are retained together/adjacent one another with the slides 18 sandwiched therebetween with four shoulder bolts 30. Shoulder bolts 30 include a tool engagement head 32, a central shaft 34 and a threaded terminal end 36. Shoulder bolts 30 are received through oval holes/openings 38 in the upper plate 14 and the threaded terminal ends 36 thereof threadingly engage and are secured in threaded holes 40 in the lower plate 12. The length of the central shafts 34 is such that, when the shoulder bolts 30 are securely engaged in holes 40, the tool engagement heads 32 are located a short distance/slightly above the upper plate 14. Preferably, oval openings 38 are about 0.390 inch in the short direction and about 0.465 inch in the long direction. Also preferably, the diameter of the shoulder bolt central shaft is about 0.375 inch. Accordingly, because the shoulder bolt heads 32 are larger than the oval openings 38, plates 12 and 14 are maintained adjacent and parallel to one another with the slides 18 sandwiched therebetween. Also, because the oval openings are larger in the long direction, the upper plate 14 is freely slidable/movable as indicated by arrows 16 but limited to a travel distance of the openings 38 long length less the central shafts 34 diameter, or about 0.090 inch (0.465−0.375=0.090). Of course, the tolerances of the several components are such that the upper plate 14 will slide freely relative to the lower plate 12 without excessive frictional engagement or binding.

A pitching rubber 42 is secured to the upper plate 14 near the back edge 14B and between left and right edges 14L, 14R. Pitching rubber 42 includes holes 44 which are aligned with threaded holes 46 in the upper plate 14. Screws 48 are received through holes 44 and are threadingly engaged and are secured in threaded holes 46 for thereby securing the pitching rubber 42 to the upper plate 14. It is noted that pitching rubber 42 can also be secured to the upper plate 14 with other types of fasteners and/or with adhesives.

Mounting holes 50 are provided in and extend through the lower plate 12. Mounting holes 50 are adapted to receive a mounting stake or screw therethrough whereby, during use, the apparatus 10 can be secured to the ground, a pitching mound, interior floors, etc. The upper plate 14 is provided with access holes 52 which are aligned with and which provide access to the mounting holes thereunder.

Figure 2:
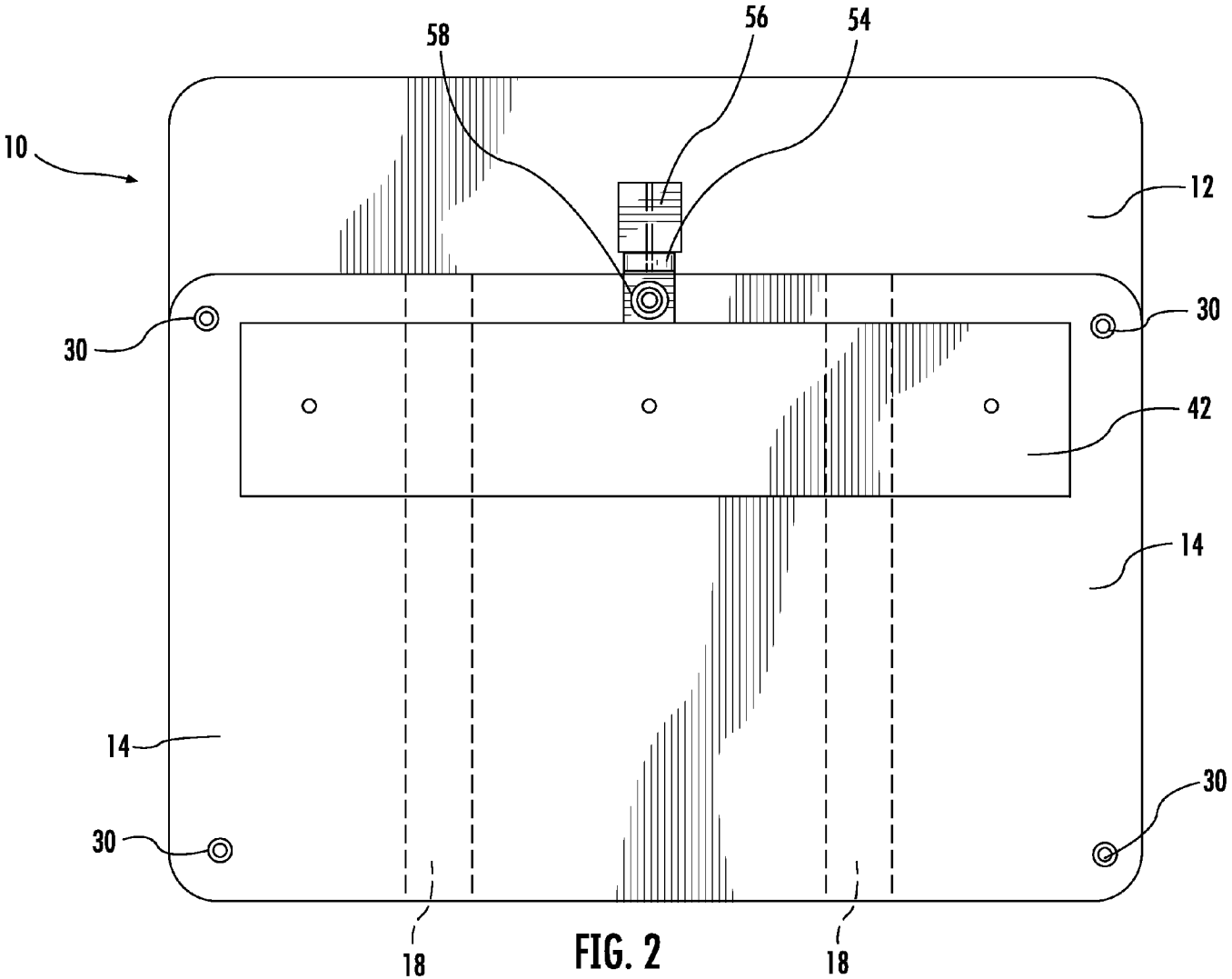
FIG. 2 is a top plan view of the apparatus shown in FIG. 1.
Figure 3:
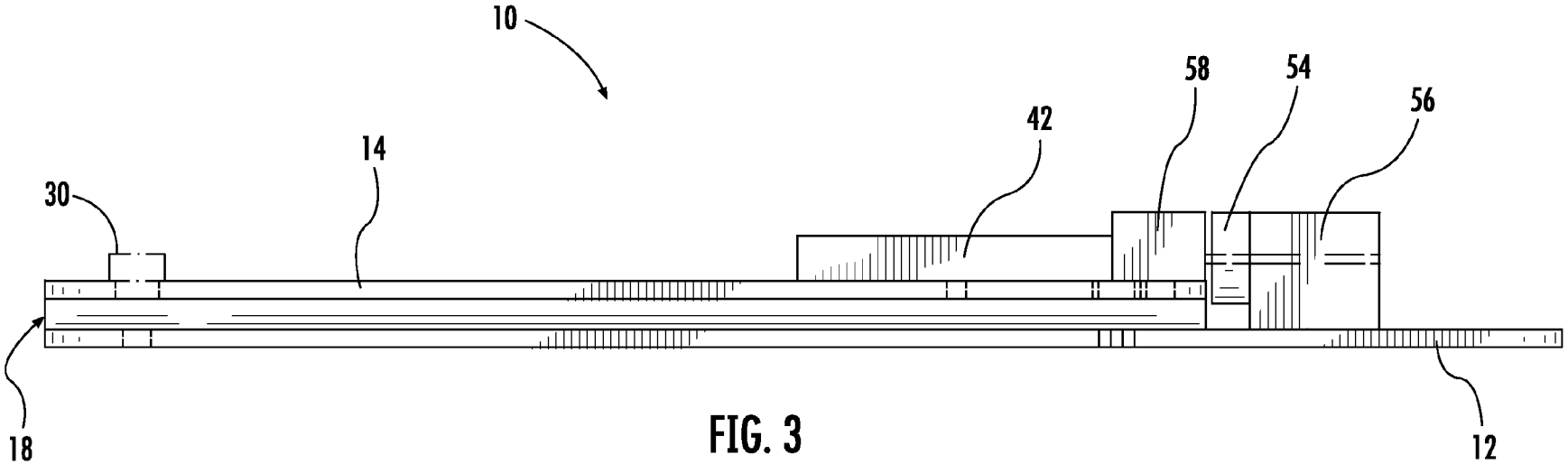
FIG. 3 is a side elevation view of the apparatus shown in FIG. 1.

Referring now to the embodiment shown in FIGS. 1-3, the apparatus 10 includes a force/compression load cell 54 secured by fasteners or other suitable means between the lower plate 12 and upper plate 14. Preferably, a bracket 56 is secured to the lower plate 12 by welding, fasteners or other suitable means and the load cell 54 is secured thereto with fasteners (not shown) for locating the load cell sensor/plunger adjacent the upper plate 14 as needed. A stud 58 can be welded or otherwise secured to the upper plate 14 and the load cell sensor/plunger can be located adjacent thereto.

Force/compression load cells are commercially available and well known to those skilled in the art and are capable to providing an analog or digital electrical output responsive to the compressive force being exerted thereon. Load cell 50 is electrically connected to a computer or other similar device (not shown) whereat the output thereof can be stored, displayed and transmitted as needed or desired. As should now be appreciated, load cell 54 acts as a stop for the linearly moveable upper plate 14 relative to the lower plate 12 and measures the applied force/leg drive therebetween.

The apparatus 10 of FIG. 1-3 is used by a baseball and softball pitcher by placing his/her foot on the upper plate 14 forward of the pitchers rubber 42. The pitcher then winds up and throws the ball, as is known and customary, pushing against the pitchers rubber 42. The pitcher's leg drive/force against the rubber 42 thereby causes the upper plate 14 to slide toward and against the load cell 54. The load cell 54, therefore, effectively measures and provides an output responsive to the pitcher's leg drive which can be stored, displayed and transmitted. The measured leg drive force can then, of course, be used as needed for training and other purposes.

Figure 11:
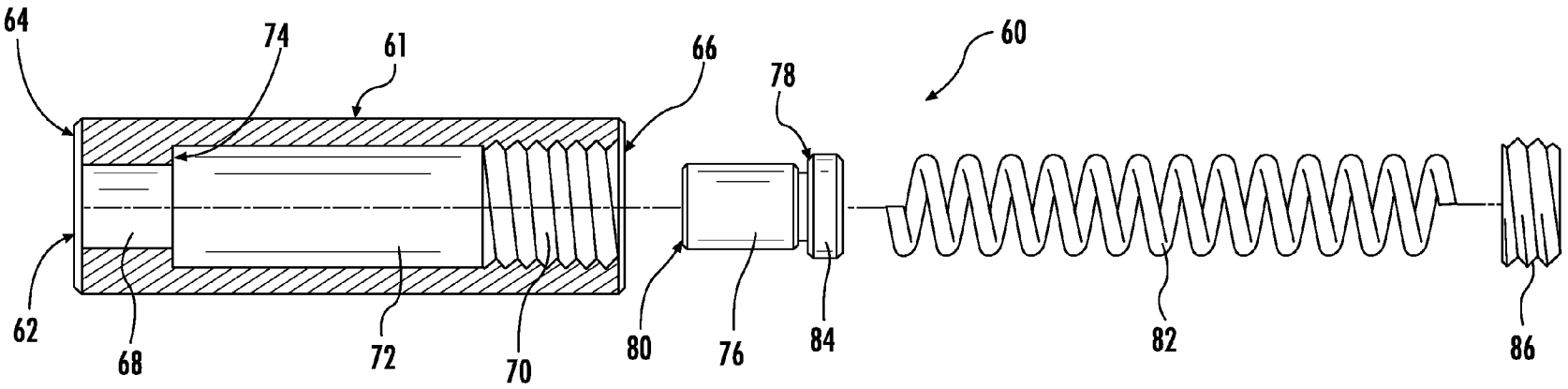
FIG. 11 is a side elevation exploded view of the spring force measuring and sound generating mechanism used in the embodiment of FIGS. 4-6; and, FIG. 12 is a cross-sectional view of an assembled mechanism shown in FIG. 11.
Figure 12:
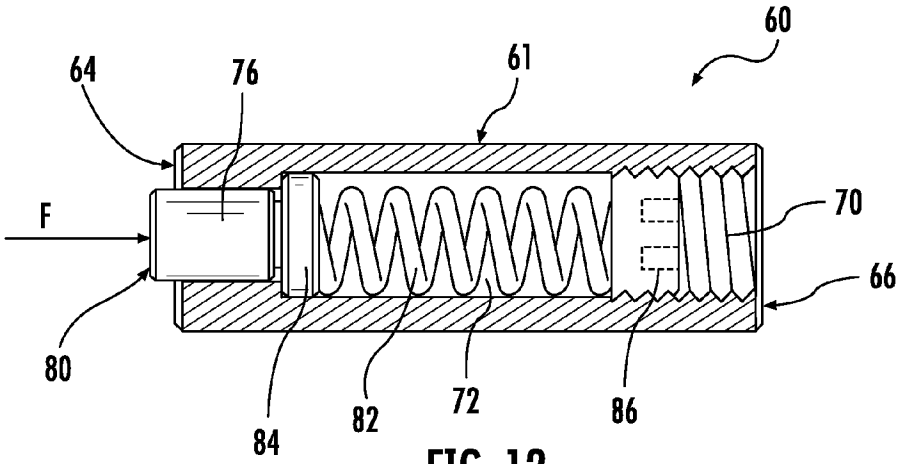

Referring now to the embodiment shown in FIGS. 4-12, the apparatus 10 includes an adjustable spring force/compression measuring and sound generating mechanism 60. As shown in FIGS. 11 and 12, mechanism 60 includes a cylindrical shell 61 having a bore 62 extending therethrough between axial terminal ends 64, 66. Bore 62 includes a plunger receiving section 68 adjacent terminal end 64, a threaded section 70 adjacent terminal end 66 and a spring receiving section 72 therebetween. An annular seat 74 is provided between the plunger receiving section 68 and the spring receiving section 77.

Figure 4:
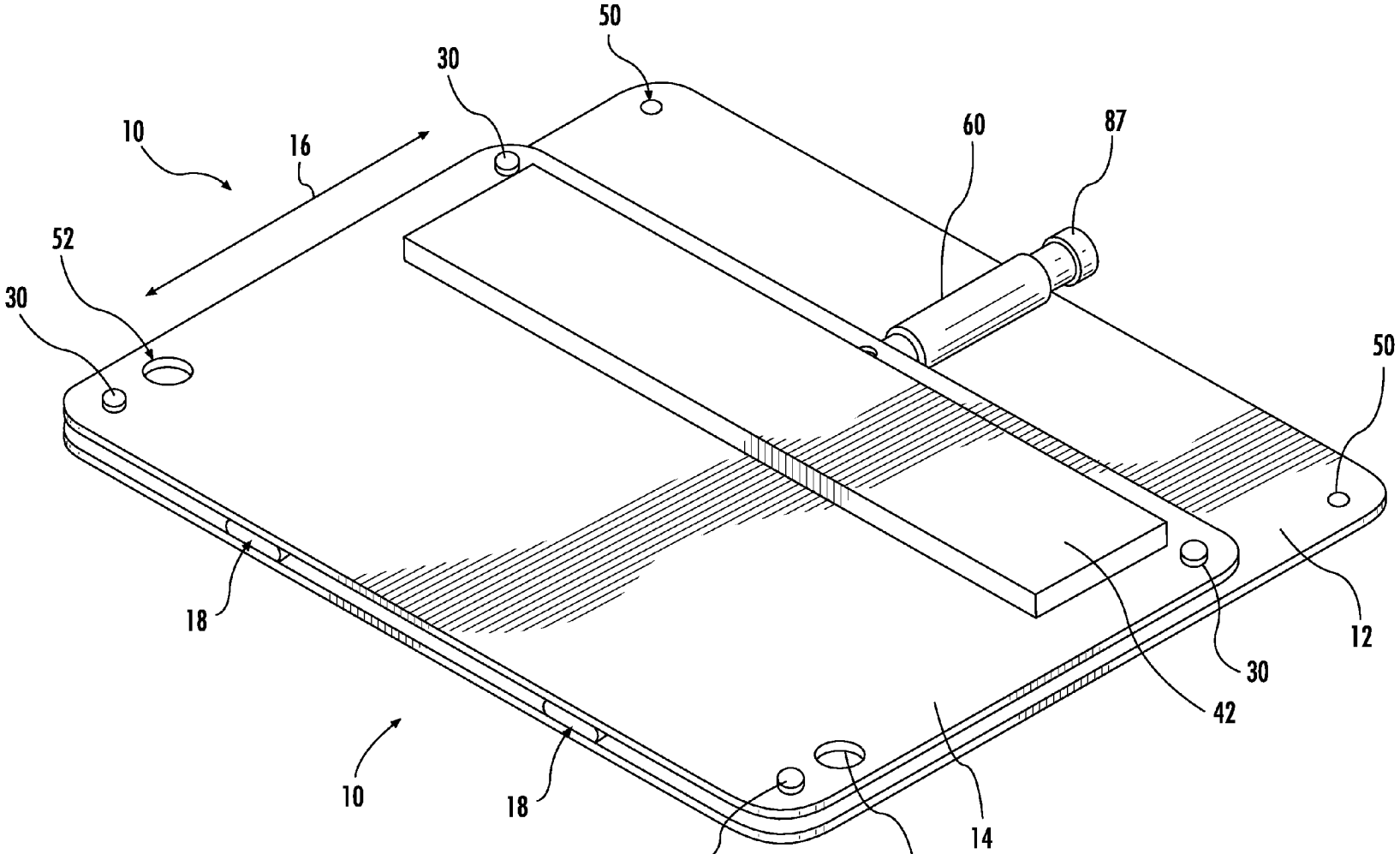
FIG. 4 is a perspective view of a second embodiment of a leg drive measuring and training apparatus constructed in accordance with the principles of the present invention.
Figure 5:
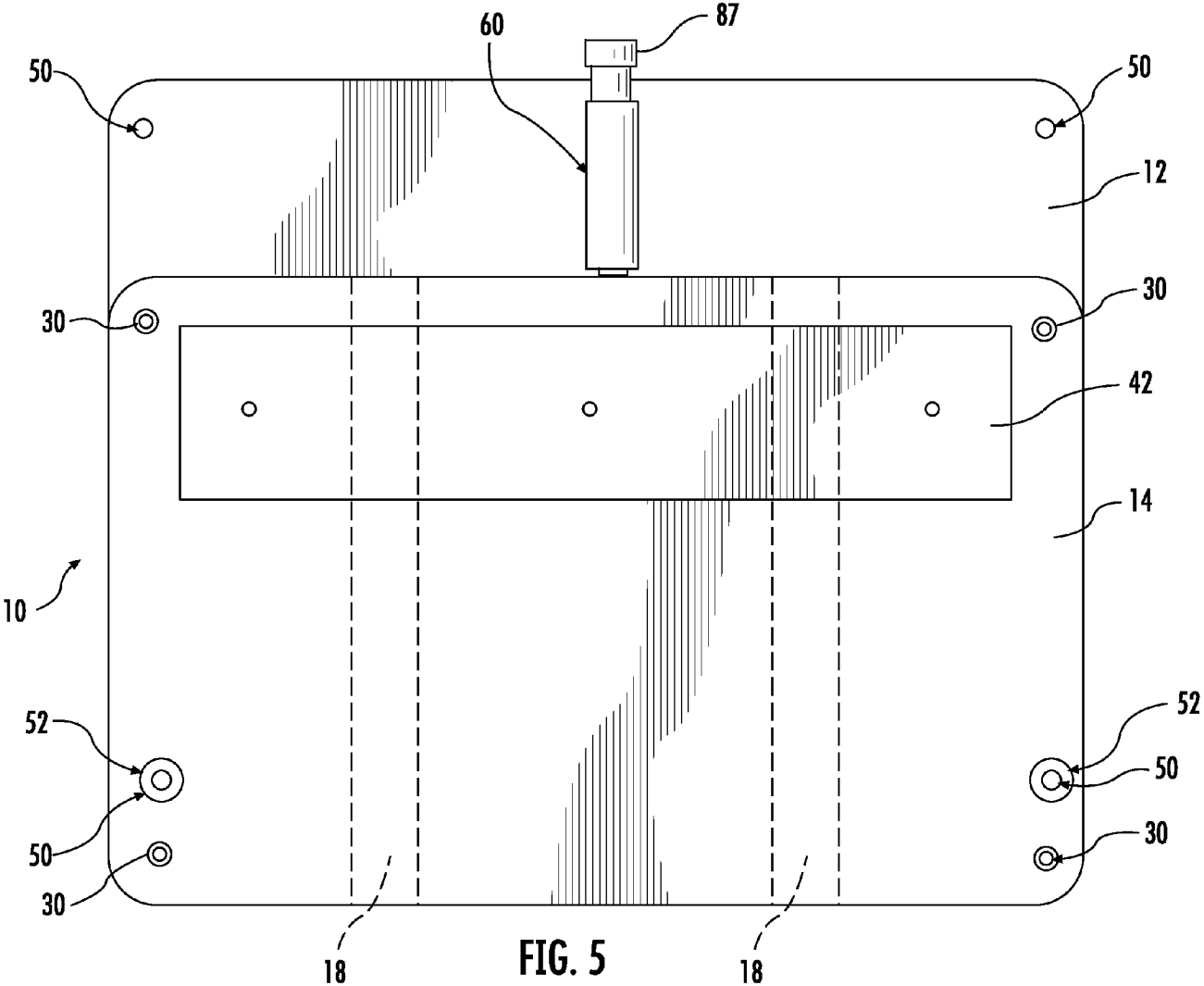
FIG. 5 is a top plan view of the apparatus shown in FIG. 4.
Figure 6:
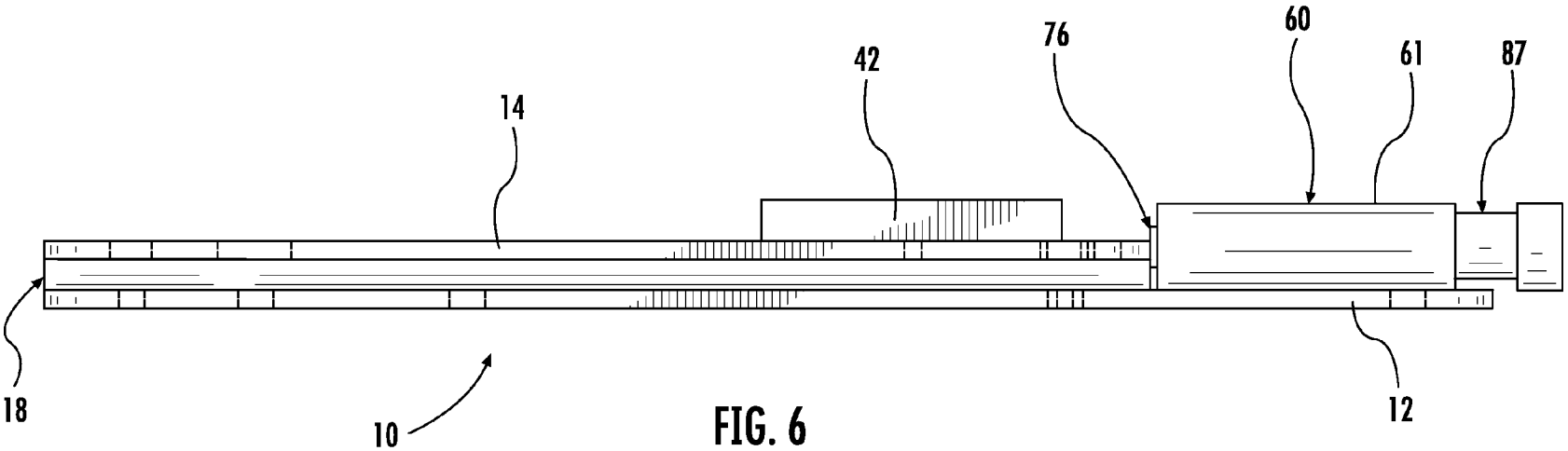
FIG. 6 is a side elevation view of the apparatus shown in FIG. 4.
Figure 7:
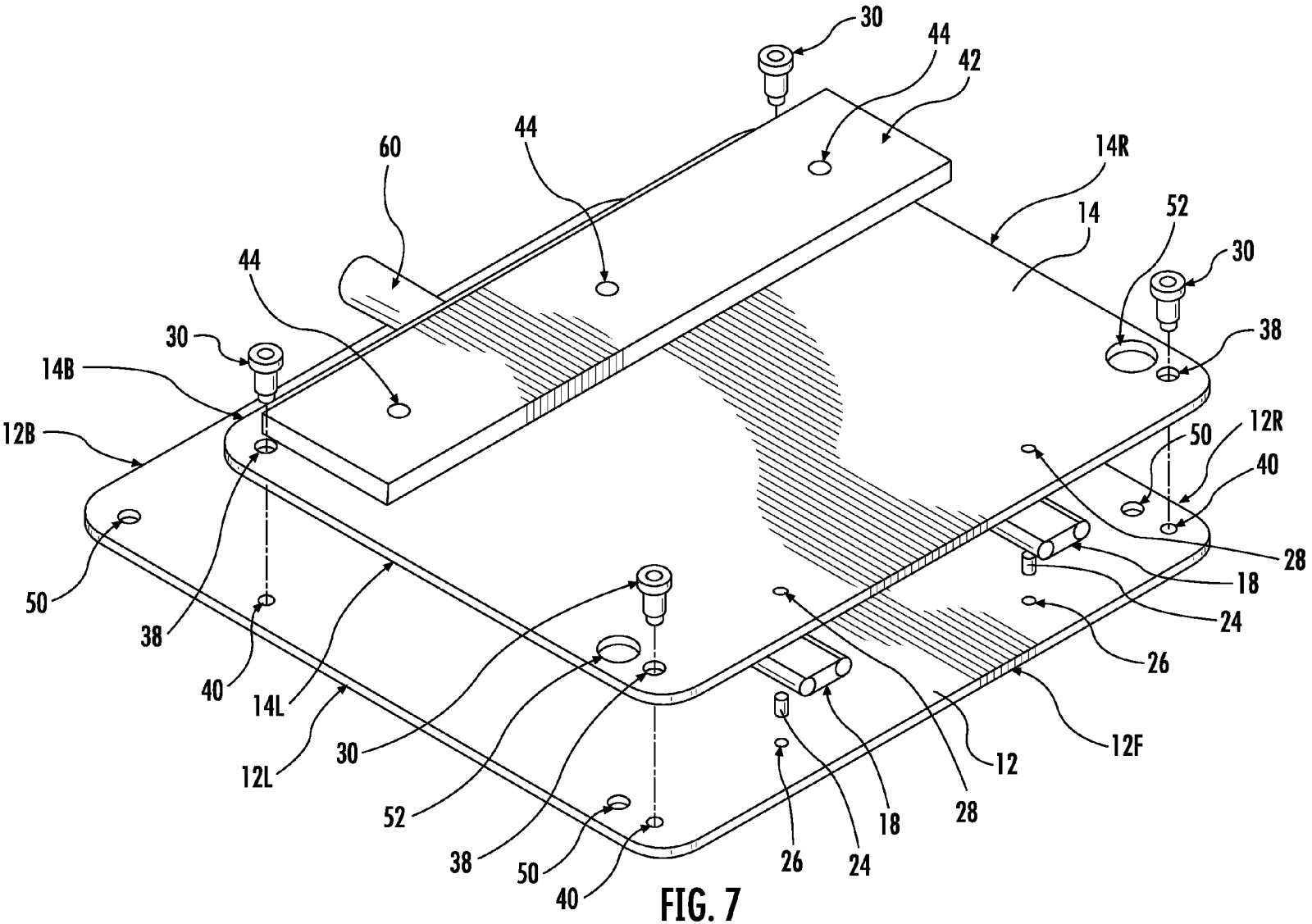
FIG. 7 is a perspective exploded view of the apparatus shown in FIG. 4.
Figure 8:
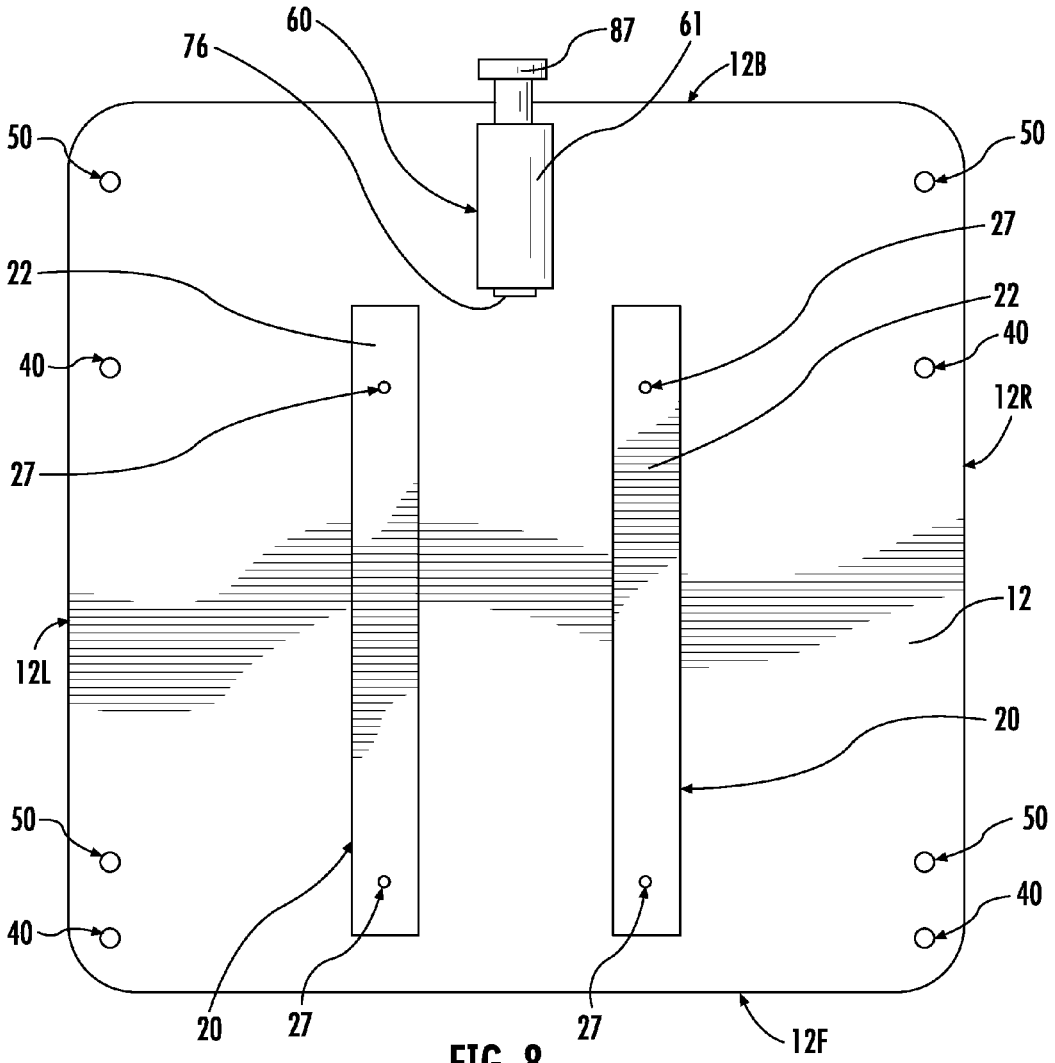
FIG. 8 is a top plan view of the lower ground engaging plate of the apparatus shown in FIG. 4.
Figure 9:
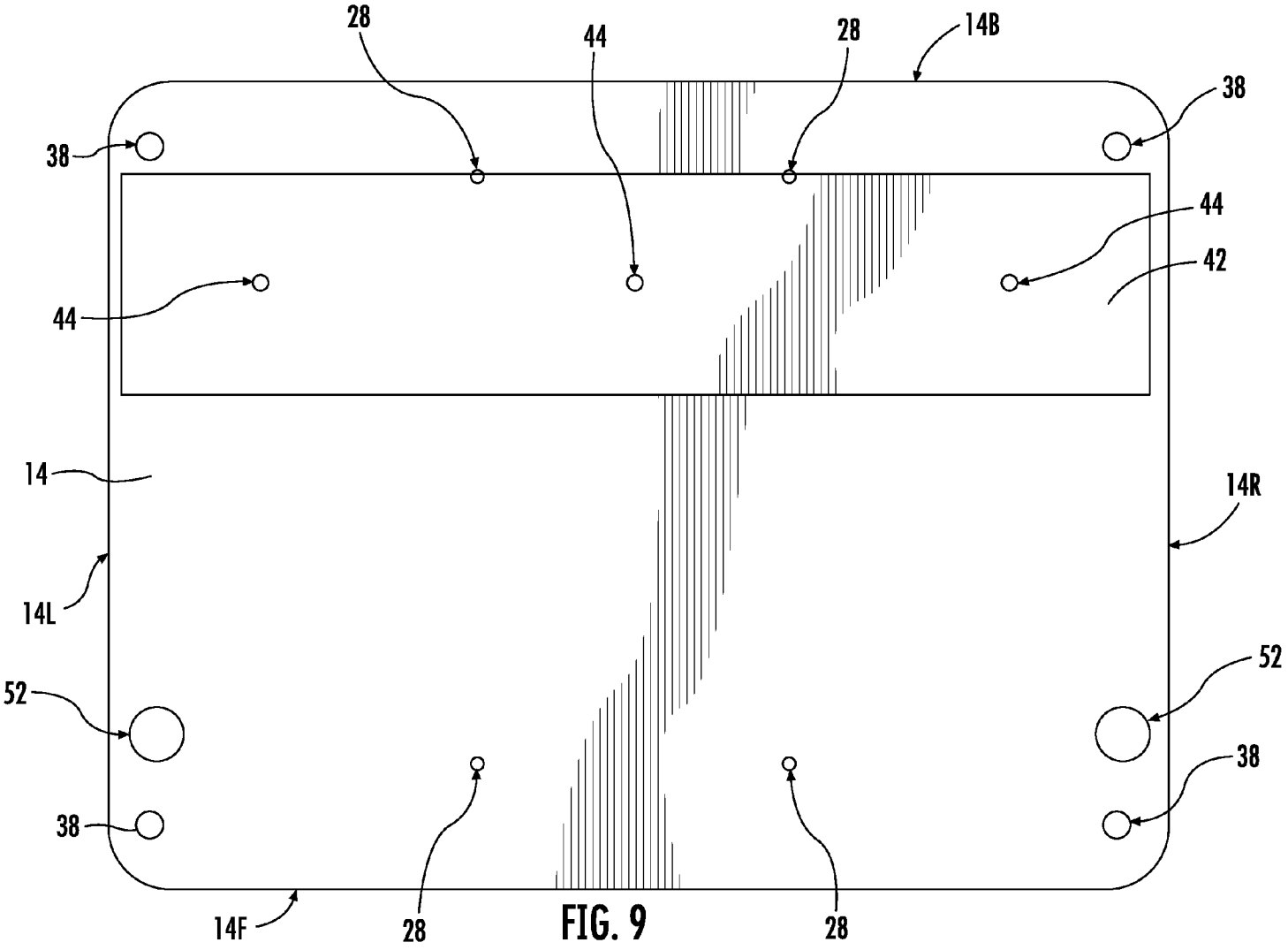
FIG. 9 is a top plan view of the upper pitcher's foot supporting plate of the apparatus shown in FIG. 4.
Figure 10:
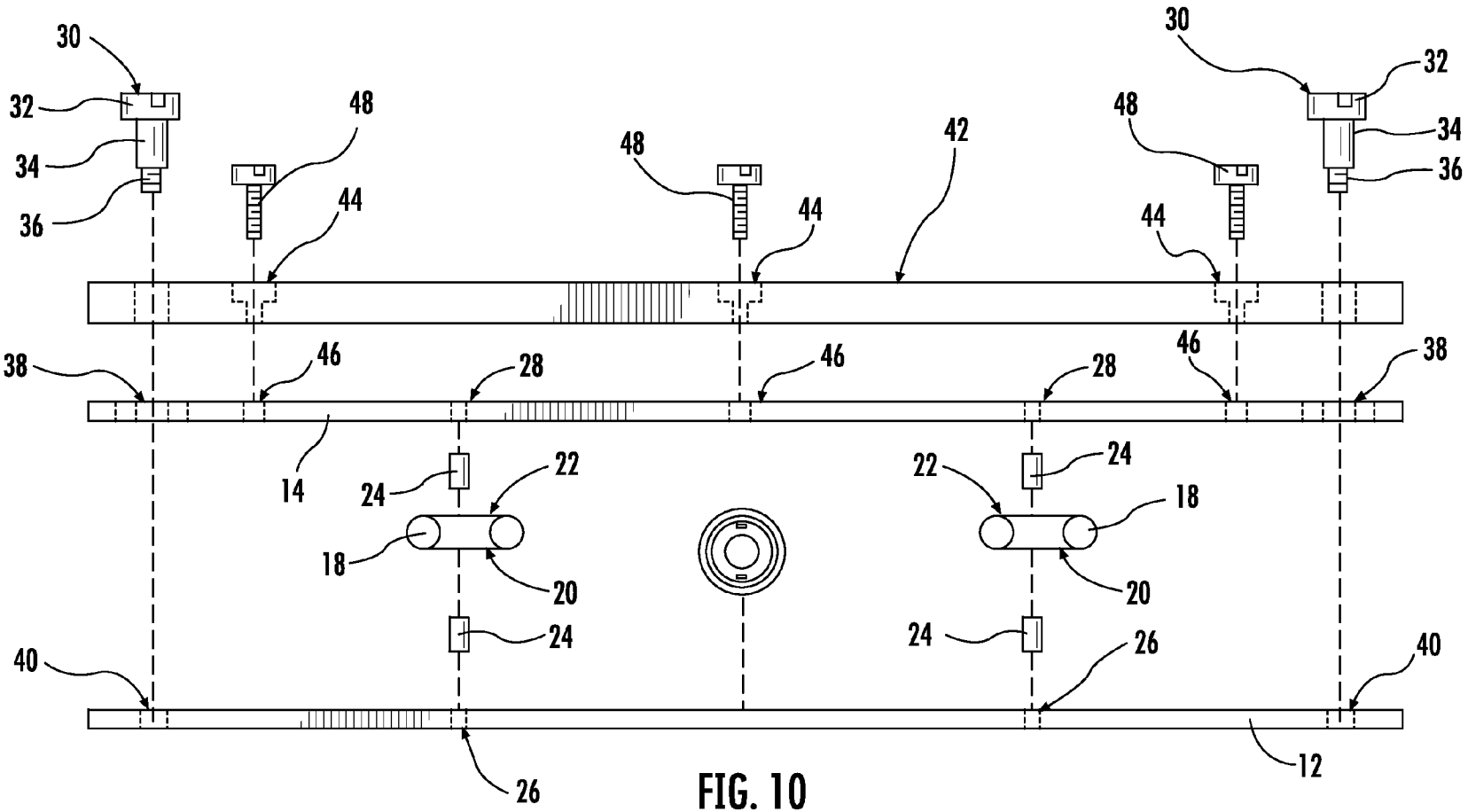
FIG. 10 is a front elevation exploded view of the apparatus shown in FIG. 4.

Plunger 76 is received through the threaded section 70 and the spring receiving section 72 and is located within section 68 whereat the annular shoulder 78 thereof is seated against annular seat 74. In this position, the terminal end 80 of plunger 76 extends beyond the terminal end 64 of the shell 61, preferably, a distance which is equal to or greater than the travel distance of the upper plate 14 described hereinabove. Spring 82 is received through the threaded section 70 and is located within the spring receiving section 72 and abutting the head 84 of plunger 76. Spring 82 is compressed and an allen screw 86 is threadingly received in threaded bore 70. As can be appreciated, allen screw 86 maintains spring 82 in compression which, in turn, maintains the plunger shoulder 78 seated against the annular seat 74. Additionally, threadingly axially adjusting allen screw 86 along the threaded section 70, the force F required to move plunger 76 against the spring 82 and lift the plunger head 84 off of the annular seat 74 is selectively adjustable. Alternatively, a thumb screw 87 can be used, as shown in FIGS. 4-6 for selectively turning and adjusting the spring force by hand.

Similar to the embodiment using a load cell 54 described hereinabove, the cylindrical shell 61 is secured by welding, fasteners or other suitable means between the lower plate 12 and upper plate 14. Preferably as shown, cylindrical shell 61 is welded to the lower plate 12 with its longitudinal axis being parallel with the upper plate 14 linear direction of travel as indicated by arrows 16, and with its terminal end 64 adjacent the upper plate back edge 14B. The terminal end 64 is spaced from the upper plate back edge 14B a distance which is less than the upper plate travel distance described hereinabove, and with the plunger terminal end 80 abutting the back edge 14B.

The embodiment of FIGS. 4-12 is similarly used by a pitcher by placing his/her foot on the upper plate 14 forward of the pitchers rubber 42 and winding up and throwing ball thereby pushing against the pitchers rubber 42. In this embodiment, the pitcher's leg drive/force causes the upper plate 14 to be forced against the plunger 76. When a sufficient leg drive/force F is exerted to overcome the spring force, plunger 70 axially retracts into the cylindrical shell 61 and the upper plate 14 slidingly moves in the direction of arrow 16 until its back edge 14B abuts/hits the shell terminal end 64. The back edge 14B hitting the shell terminal end 64 generates an audible sound which is transmitted through the lower and upper plates 12, 14 and which thereby notifies the pitcher that the spring force has been overcome. As should now be appreciated, the spring force can be calibrated so that, depending on the axial location of the screw 86, 87 the pitcher will know the value of the drive force required to overcome the spring force and generate the audible sound. Accordingly, the apparatus 10 can thereby be used as needed or desired for training and improving the pitcher's leg drive.

While this invention has been described as having an exemplary design, the present invention may be further modified within the spirit and scope of this disclosure. This application is therefore intended to cover any variations, uses, or adaptations of the invention using its general principles.

What is claimed is:

1. A pitching training apparatus comprising:
a lower ground engaging plate;
an upper pitcher's foot supporting plate including a pitcher's rubber;
wherein said lower and upper plates are linearly movable relative to each other;
a force measuring element between said upper and lower plates whereby, by pushing against the upper plate while pitching, said upper plate moves linearly and said force element exhibits an output indicative of the pitcher's leg drive.

2. The apparatus of claim 1 wherein said pitcher's rubber is separable from said upper plate.

3. The apparatus of claim 1 wherein a plurality of slides are sandwiched between said upper and lower plates, and wherein each of said slides is secured to each of said lower and upper plates whereby said lower and upper plates are linearly movable relative to each other.

4. The apparatus of claim 1 wherein:
a pair of holes are provided extending through the upper plate;
a shoulder bolt is received through each of said holes and is secured to the lower plate, whereby said upper and lower plates are maintained parallel adjacent one another and said linear movement is limited by the size of the holes.

5. The apparatus of claim 4 wherein said holes are oval shaped.

6. The apparatus of claim 1 wherein said element is a load cell providing an electrical output indicative of the pitcher's leg drive.

7. The apparatus of claim 6 wherein said output includes an audible sound.

8. The apparatus of claim 1 wherein said output includes an audible sound.

9. The apparatus of claim 1 wherein:
said element comprises a cylindrical shell having a bore extending therethrough;
a plunger is located in said bore and has a terminal end projecting beyond said shell;
said plunger terminal end abuts said upper plate; and,
a spring is located in said bore urging said plunger against said upper plate with a spring force.

10. The apparatus of claim 9 wherein said spring force is selectively adjustable.

11. The apparatus of claim 9 wherein a threaded fastener is provided adjacent said spring, said fastener being adapted to engage said spring and thereby adjust a length of said spring, whereby said spring force is selectively adjustable.

12. The apparatus of claim 9 wherein said output is an audible sound generated by said upper plate hitting said shell when said spring force is overcome.

13. The apparatus of claim 1 further comprising:
said pitcher's rubber being separable from said upper plate;
a plurality of slides are sandwiched between said upper and lower plates, and wherein each of said slides is secured to each of said lower and upper plates whereby said lower and upper plates are linearly movable relative to each other;
a pair of holes extending through the upper plate; and,
a shoulder bolt received through each of said holes and being secured to the lower plate, whereby said upper and lower plates are maintained parallel adjacent one another and said linear movement is limited by the size of the holes.

14. The apparatus of claim 13 wherein said element is a load cell providing an electrical output indicative of the pitcher's leg drive.

15. The apparatus of claim 13 wherein:

said element comprises a cylindrical shell having a bore extending therethrough;

a plunger is located in said bore and has a terminal end projecting beyond said shell;

said plunger terminal end abuts said upper plate;

a spring is located in said bore urging said plunger against said upper plate with a spring force;

wherein a threaded fastener is provided adjacent said spring, said fastener being adapted to engage said spring and thereby adjust a length of said spring, whereby said spring force is selectively adjustable; and, wherein said output is an audible sound generated by said upper plate hitting said shell when said spring force is overcome.

16. A pitching training apparatus comprising:

a lower ground engaging plate;

an upper pitcher's foot supporting plate including a pitcher's rubber;

wherein said lower and upper plates are movable relative to each other in a linear direction;

a spring element between said upper and lower plates whereby, by pushing against the upper plate while pitching, said upper plate moves linearly and said spring element exhibits an output indicative of the pitcher's leg drive.

17. The apparatus of claim 16 wherein said pitcher's rubber is separable from said upper plate.

18. The apparatus of claim 16 wherein a plurality of slides are sandwiched between said upper and lower plates, and wherein each of said slides is secured to each of said lower and upper plates whereby said lower and upper plates are linearly movable relative to each other.

19. The apparatus of claim 16 wherein:

a pair of holes are provided extending through the upper plate;

a shoulder bolt is received through each of said holes and is secured to the lower plate, whereby said upper and lower plates are maintained parallel adjacent one another and said linear movement is limited by the size of the holes.

20. The apparatus of claim 19 wherein said holes are oval shaped.

21. The apparatus of claim 16 wherein said output includes an audible sound.

22. The apparatus of claim 16 wherein:

said spring element comprises a cylindrical shell having a bore extending therethrough;

a plunger is located in said bore and has a terminal end projecting beyond said shell;

said plunger terminal end abuts said upper plate; and, a spring is located in said bore urging said plunger against said upper plate with a spring force.

23. The apparatus of claim 22 wherein said spring force is selectively adjustable.

24. The apparatus of claim 22 wherein a threaded fastener is provided adjacent said spring, said fastener being adapted to engage said spring and thereby adjust a length of said spring, whereby said spring force is selectively adjustable.

25. The apparatus of claim 22 wherein said output is an audible sound generated by said upper plate hitting said shell when said spring force is overcome.

26. The apparatus of claim 16 further comprising:

said pitcher's rubber being separable from said upper plate;

a plurality of slides are sandwiched between said upper and lower plates, and wherein each of said slides is secured to each of said lower and upper plates whereby said lower and upper plates are linearly movable relative to each other;

a pair of holes extending through the upper plate; and, a shoulder bolt received through each of said holes and being secured to the lower plate, whereby said upper and lower plates are maintained parallel adjacent one another and said linear movement is limited by the size of the holes.

27. The apparatus of claim 26 wherein:

said element comprises a cylindrical shell having a bore extending therethrough;

a plunger is located in said bore and has a terminal end projecting beyond said shell;

said plunger terminal end abuts said upper plate;

a spring is located in said bore urging said plunger against said upper plate with a spring force;

wherein a threaded fastener is provided adjacent said spring, said fastener being adapted to engage said spring and thereby adjust a length of said spring, whereby said spring force is selectively adjustable; and, wherein said output is an audible sound generated by said upper plate hitting said shell when said spring force is overcome.

* * * * *